United States Patent [19]

Nussbaum

[11] Patent Number: 5,007,915

[45] **Date of Patent: * Apr. 16, 1991**

[54] DEPILATORY DEVICE

[75] Inventor: Avraham Nussbaum, Moshav Mazor, Israel

[73] Assignee: Crestmoore Ltd., Hong Kong

[ * ] Notice: The portion of the term of this patent subsequent to May 8, 2007 has been disclaimed.

[21] Appl. No.: 442,778

[22] Filed: Nov. 28, 1989

Related U.S. Application Data

[63] Continuation of Ser. No. 258,584, Oct. 17, 1988, Pat. No. 4,923,463.

[30] Foreign Application Priority Data

Feb. 28, 1988 [IL] Israel ..... 85568

[51] Int. Cl.[5] ..... A61B 17/00

[52] U.S. Cl. ..... 606/133

[58] Field of Search ..... 606/133, 131; 17/11.1 R, 47

[56] References Cited

U.S. PATENT DOCUMENTS

| | | | |
|---|---|---|---|
| 1,232,617 | 7/1917 | Shipp . | |
| 2,423,245 | 7/1947 | Magnus et al. | 606/131 X |
| 2,480,252 | 8/1949 | Magnus | 128/355 |
| 2,714,788 | 8/1955 | Giovanna | 128/355 X |
| 2,900,661 | 8/1959 | Schnell | 17/11.1 R |
| 4,079,741 | 3/1978 | Daar et al. | 128/355 |
| 4,279,253 | 7/1981 | Haes et al. | 128/355 |
| 4,524,772 | 6/1985 | Daar et al. | 128/355 |
| 4,726,375 | 2/1988 | Gross et al. | 128/355 |

FOREIGN PATENT DOCUMENTS 147285 7/1985 European Pat. Off. .

*Primary Examiner*—Michael H. Thaler
*Attorney, Agent, or Firm*—Charles E. Baxley

[57] ABSTRACT

According to the present invention, there is provided a depilatory device, comprising a manually grippable casing, having an electric motor; and an electric switch carried on said casing for energizing or de-energizing said motor. A hair plucking body is mounted onto said casing, having an exposed section plate, having a plurality of extended rotatable pins mounted into slide bearings on the circumference of said exposed plate. A belt is rotatable by said motor's to run around said extended rotatable pins continuously, so that when the depilatory device is placed in touch with body hair, said hair will be caught in gaps between said extended pins and said rotatable belt, clamping the hair towards the rotation of said pins and belt, thus pulling said hair out along the plate.

6 Claims, 4 Drawing Sheets

DEPILATORY DEVICE

This is a continuation of application Ser. No. 258,584, filed Oct. 17, 1988 now Pat. No. 4,923,463.

BACKGROUND OF THE INVENTION

The present invention relates to depilatory devices which remove body hair, and are used for cosmetic purposes.

A number of depilatory devices have been proposed in the past. Some devices include discs arranged to provide gaps of wedge-like configurations for catching and plucking the hair; a device of this type is illustrated by U.S. Pat. No. 2,900,661. Other devices include helical springs which define hair-catching gaps between their windings; examples of the latter are described in U.S. Pat. Nos. 1,232,617, 4,079,741 and 4,524,772, the first two being axial helical springs, and the latter being an arcuate spring, and U.S. Pat. No. 4,726,375 describing a rotable rubber or plastic slit cylinder catching the hair between the slits and pulling the hair off when rotating around its axis. It is an object of this invention to provide a depilatory device which uses neither discs nor helical springs but defines the hair-catching gaps in another manner producing several advantages over the prior art as shall be defined below.

According to the present invention, there is provided a depilatory device, comprising a manually grippable casing, having an electric motor; and an electric switch carried on said casing for energizing or de-energizing said motor. A motor base hair plucking body rotatably mounted onto said casing is also included and has an exposed section plate, having a plurality of extended rotatable pins mounted into slide bearings on the circumference of the said exposed plate. A belt, rotatable by said motor's central shaft runs around said extended rotatable pins continuously upon start-up of the motor, so that when the device is placed in touch with body hair, said hair will be caught in gaps between said extended pins and said rotatable belt, clamping the hair towards the rotation of said pins and belt, thus pulling the said hair out.

A substantial difference in construction of the depilatory device of the present invention, versus the devices described in the known prior art, is that the present exposed section in touch with a user's skin is not made of metal, but of a rubber or elastomeric belt running continuously around the pins.

Another important advantage of the device is that it plucks hair in all directions simultaneously, whereas the devices in the prior art are all operating unilaterally.

A further important advantage of the present device is that it pulls the hair parallel to the skin, and from tests carried out comparing the function of the present device to the prior art units, it was found that this feature greatly reduces pain during the depilatory process.

A further advantage of the device, is its compact form enabling use of a smaller casing than would be required for the devices described in the prior art.

In the preferred embodiment, the motor installed in the device is of 10-watt, direct current, with 5,000–10,000 RPM, energized by either disposable or rechargeable 9-volt batteries, or any other suitable power supply.

The preferred embodiment has a casing made of ABS or similar plastic. Said belt rotating around the pins is made of rubber, or any suitable elastomeric or plastic flexible material; the belt could be either flat or cylindrical 3–5mm wide. The structure of said belt can be either flat, circular, trapeze, or a combination of flat or circular. In order to achieve an improved friction factor between the belt and the hair to be plucked, one could roughen the outer surface of the belt, or introduce small teeth-like projections, so that when the belt comes into contact with the hair, it will be caught by the belt and pulled towards said pins to be plucked.

In the preferred embodiment, the exposed section to the user's body is a plate made of either steel or rigid plastic, or elastomer 3–10mm thick, having slide bearing bores on its circumference in a T form or any other suitable form. The number of pins in said exposed section could be any acceptable number between a minimum of 2 to 30 (or more).

The pins are 5–8mm high, 2–4mm in diameter and rotate freely in the slide bearing bores, on the exposed section. The pins could be made of any rigid tough material such as steel, rubber or plastic. The pins' extensions out of the exposed section would be in the range of 3–5mm in line with the width of the belt.

In the preferred embodiments, the combination of the pins and belt can be as follows:

either two pins and the belt running between them;

or three pins and the belt running on the outer surface forming a triangle. This structure was found to be efficient for long hair;

or a plurality of pins in a circle with the belt running on the outer circumference;

or a plurality of pins placed on an inner circle, and another plurality of pins on an outer circle with the belt running alternatively between an outer pin and an inner pin;

or a plurality of pins with a belt running around the pins and crossing its pathway, thus increasing the pulling effect on the hair;

or a depilatory device wherein said device has a plurality of pairs of pins, having a belt run between said pins, and wherein each of said pairs is rotated by the driving pin connected to said rotatable central shaft; and having a third free moving rotatable pin attached to said driving pin, having said belt pass between them, so that any hair caught by the belt in the vicinity of said two attached pins will be pulled out by the rotational movement of the pins, and running belt;

or a device having instead of a pair of pins, a triangular pin configuration with attached rotatable pins close to any required number of pins in the triangle; so that each triangular head having said two pins with said belt running between them can act as a depilating unit.

These last two devices are particularly useful for depilating short hair, or depilating hair having being previously treated with oil or cream.

In a further embodiment, said motor runs a central shaft having a gear wheel mounted on it; and said gear wheel rotates, by the aid of a plurality of gear wheels engaged to said first gear on the central shaft, a plurality of auxiliary shafts which rotate several of said pins around which rotate said belt. This mechanism gives a better distribution of power to said pins and belt rotation.

In another preferred embodiment, the plucking head including said pins and belt can be dismounted from the body of the main device; by having a cassette-like arrangement containing the pins and belt mounted in a plastic member, having a plurality of shaft connectors all to be mounted and hinged to a plurality of shafts rotated by said central shaft and motor. So that when said plucking head cassette is hinged to said shafts rotated by the motor and the motor is energized by said switch, the plucking process can be commenced when the user's hair is brought into contact with said pins and rotating belt. This device enables the user to dispose of the plucking head after several uses, or wash and clean the plucking head after use of an hair remaining on the surface of said pins or belt. The device can thus be designed to have several combinations of pins and belt as described below for different kinds of hair, or different lengths of hair.

In another preferred embodiment of the invention, there is provided a depilatory device for removing body hair comprising a manually grippable casing having an electric motor; and an electric switch carried on said casing for energizing or de-energizing said motor; and a motor base is mounted onto said casing, having an exposed section plate, having a plurality of pins mounted into slide bearings mounted onto the circumference of said exposed plate, and having the said pins secured to a plurality of gear wheels engaging one another, and said pins extend out of said gear wheels; and a belt wound around the pins, so that when the pins turn, the belt runs continuously around the pins; and said electric motor having a shaft secured to a driving gear wheel which is engaged to any of said gear wheels secured to said pins; so that when the motor rotates, the driving wheel engages one of said gear wheels which rotate all other gear wheels, thus rotating the pins and causing said belt to run continuously, so that when the device is placed in touch with the body hair said hair will be caught in the gaps between the extended pins and said rotatable belt, clamping other hair towards the rotation of said pins and belt, thus pulling the hair out.

Further features of the invention can be seen in the description below of the preferred embodiment illustrated in the drawings.

DESCRIPTION OF THE INVENTION

Figure 1:
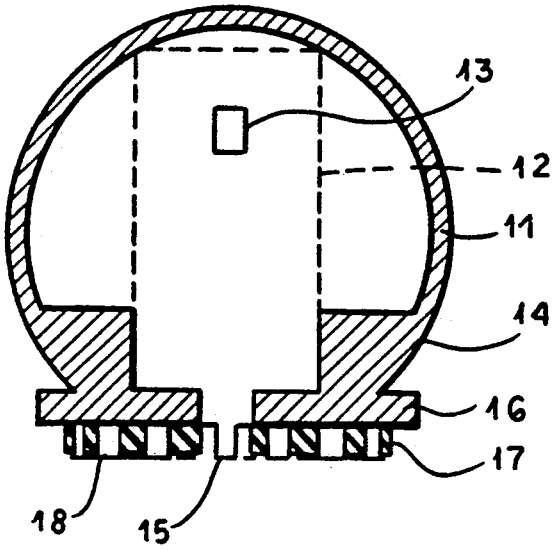
FIG. 1 illustrates a cross section of the casing body, the motor and the exposed plate section.

The depilatory device illustrated in FIG. 1 comprises a manually grippable casing 11, having a motor 12 housed in it. The motor 12 is activated by a switch 13. A motor shaft 15 penetrates through an exposed section plate 16, and rotates a belt 17 which runs between pins 18. A motor body base 14 is formed on the casing 11 and is joined to the exposed section plate 16.

Figure 2:
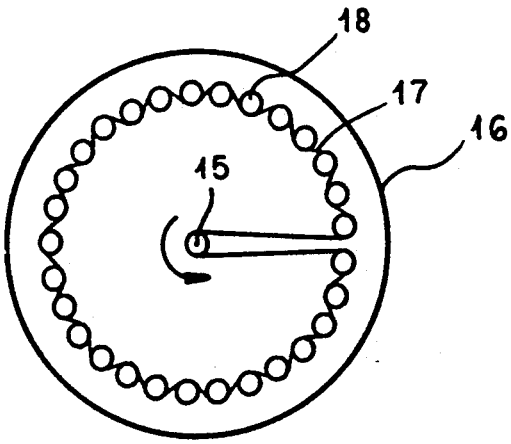
FIG. 2 illustrates a bottom view of the exposed section rotating showing the pins and rotatable belt.

In FIG. 2 a top view of the exposed section plate 16 is shown wherein the motor's shaft 15 rotates the belt 17 which runs between the pins 18.

Figure 3:
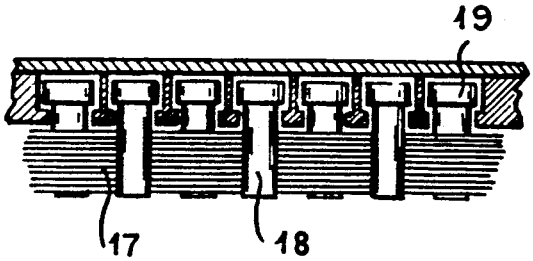
FIG. 3 illustrates an enlarged detail of the exposed plate section.

FIG. 3 illustrates an enlarged cross section of the exposed section plate 16, showing the T-shaped slide bearing borings 19, into which the pins 18 are journaled to the casing body (not seen) for rotation.

Figure 4:
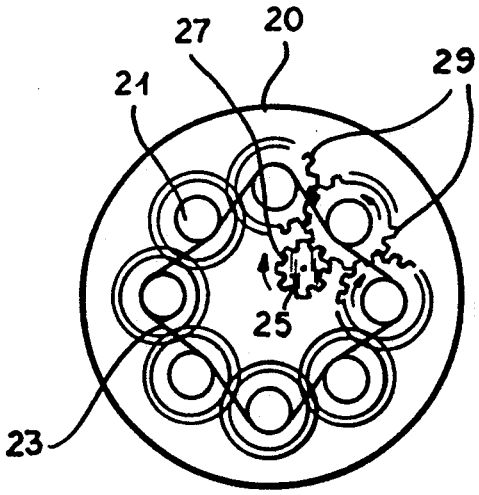
FIG. 4 illustrates a bottom view of the gear wheels engaged to each other, and to the driving gear on the shaft and also shows the pins and the belt.

FIG. 4 illustrates an alternative embodiment of this invention in which a motor shaft 25 rotates a driving gear wheel 27 which is engaged in turn to any one of a plurality of gear wheels 29 engaged to one another on the circumference of an exposed section plate 20. Pins 21 are secured to gear wheels 29 and move freely in bearings situated in the exposed section plate 20. The pins 21 are extended slightly and a belt 23 is wound between the pins and rotates freely when the motor is switched on to cause all the gear wheels to rotate.

Figure 5:
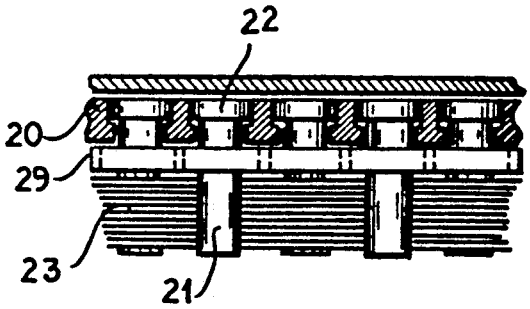
FIG. 5 illustrates a cross section of the gear wheel, pin and belt.

FIG. 5 illustrates a cross section of the exposed section plate 20, having T-shaped sliding bearing borings 22 into which pins 21 are fitted. The pins 21 extend through gear wheels, 29 to which they are secured. The belt 23 is wound around said extended pins 21.

Figure 6:
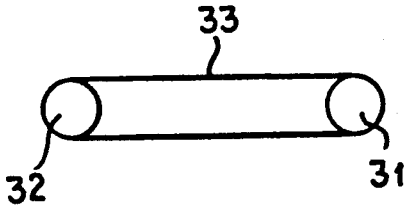
FIGS. 6, 7, 8 and 9 illustrate different combinations of pin and belt arrangements.

FIG. 6 illustrates two pins 31 and 32, having a belt 33 rotating around them.

Figure 7:
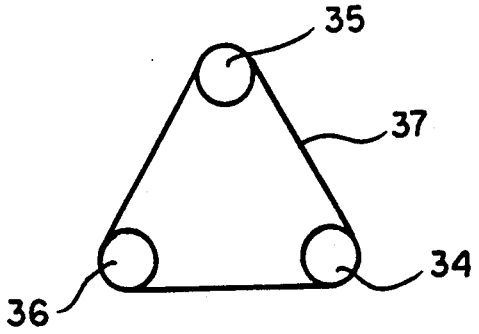

FIG. 7 illustrates a triangular arrangement having three pins 34, 35 and 36 with a belt 37 rotating on the outer circumference of the pins.

Figure 8:
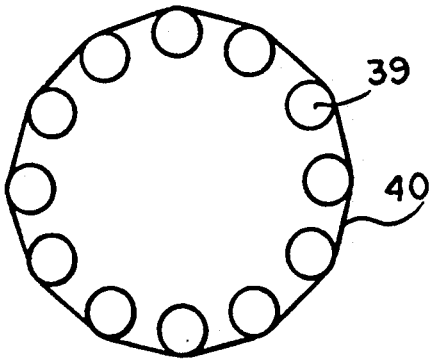

FIG. 8 illustrates a plurality of pins 39, and a belt rotating on the outer circumference of said pins.

Figure 9:
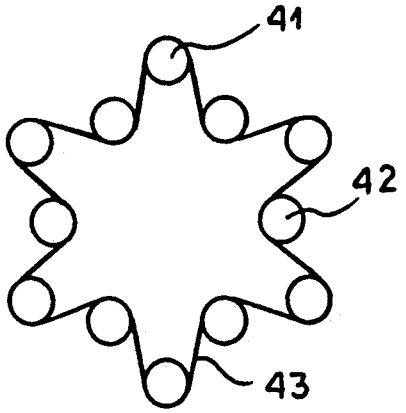
Figure 17:
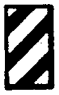
FIGS. 17, 18 and 19 illustrate cross sections of the preferred shapes.

FIG. 9 illustrates a plurality of pins 41 placed on the outer circumference of a first circle and a plurality of pins 42 placed on an inner circle, and a belt 43 rotating on the outer circumference of pins 41 and the inner circumference of pins 42.

Figure 10:
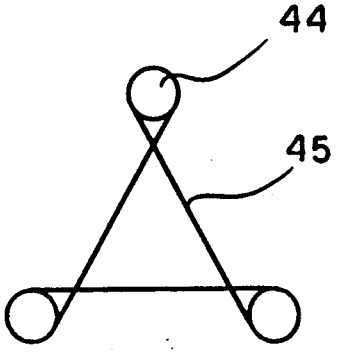
FIGS. 10 and 11 illustrate a single shaft driving mechanism connected to a plucking body having three pins and a belt.
Figure 19:
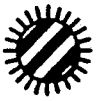
Figure 18:
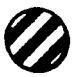

FIG. 10 illustrates a plurality of pins 44 disposed in a triangular array and having a belt 45 rotating around the pins and said belt crossing its path between successive of the pins.

Figure 11:
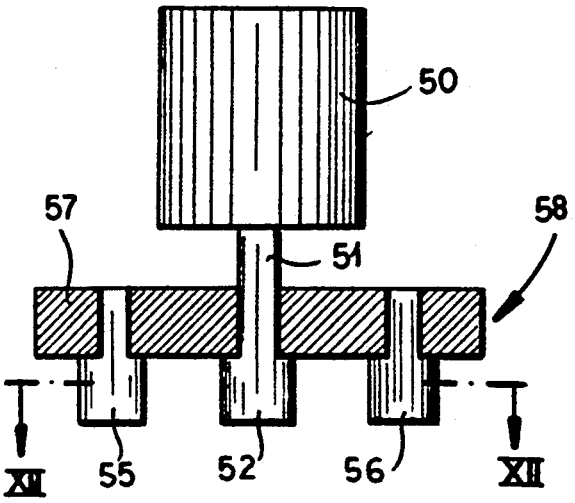
Figure 12:
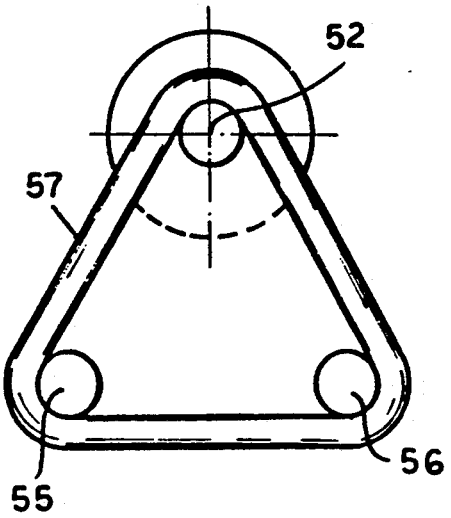
FIGS. 12 and 13 illustrate a device having a motor rotating a central shaft which is attached to a gear wheel which engages three peripheral gear wheels connected to three driving shafts. The three shafts are connectable to a plucking body shown as a detachable cassette.

FIGS. 11 and 12 illustrate an arrangement of a device having a motor 50 rotating a shaft 51 connected to a driving inner pin 52, which with the aid of a belt 57, rotates outer pins 55 and 56. Connection of the shaft 51 to the pin 52 can be made detachable, so that a plucking body generally designated 58 carrying the belt and pins can also be detached, changed or removed from the main body of the device.

Figure 13:
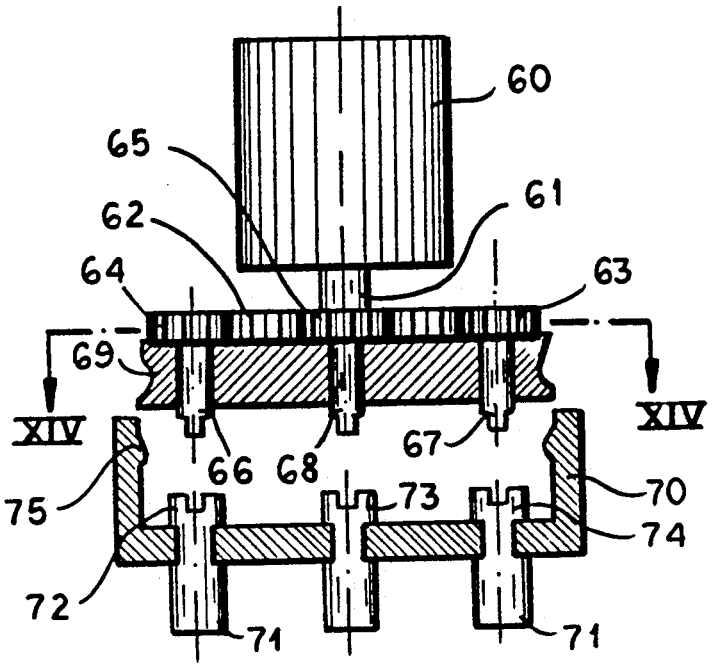
Figure 14:
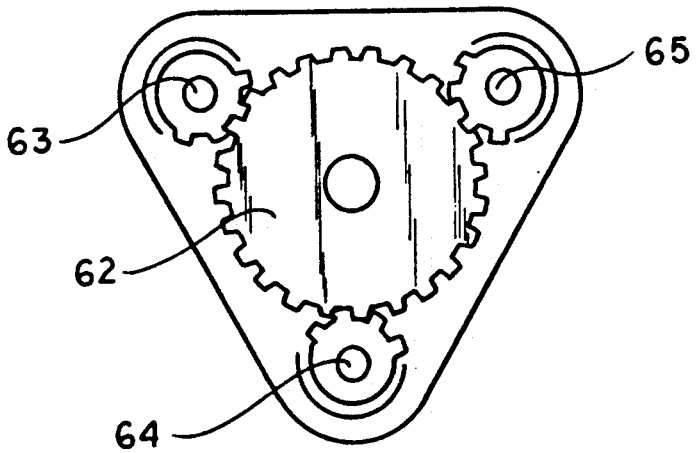
FIG. 14 is a view taken along line XIV—XIV as FIG. 13.

FIGS. 13 and 14 illustrate a depilatory device having a motor 60 connected to a shaft 61, having on it a gear wheel 62 mounted on said shaft 61. The gear wheel 62 engages with three satellite gear wheels 63, 64 and 65, which rotate three shafts 66, 67 and 68 mounted into an end plate 69. The plucking cassette 70 has a plurality of pins 71 on its outer face, having a belt mounted on them (not seen), and having three shaft connectors 72, 73 and 74 on their inner surface connected to the pins 71 which can be connected to the shafts 66, 67 and 68, and the plucking cassette 70 having a detent rim 75 on its inner surface which engages a mating indent 69 in the motor's end plate 69 when engaging the shafts to the pin connectors.

Accordingly when the plucking cassette 70 is engaged to the motor's end plate 69, and the motor 60 is activated rotating the shaft, 61, thus rotating the three shafts 66, 67 and 68, the shaft connectors 72, 73 and 74 rotate the pins 71, thus rotating a belt (not seen) thus enabling the user to pluck out hair.

Figure 15:
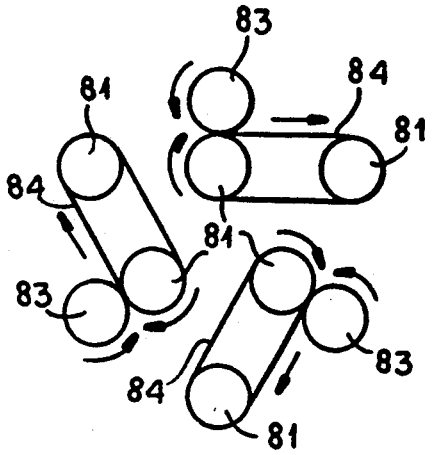
FIGS. 15 and 16 illustrate arrangements of pairs, or triangles of pins with a belt running around them having one or more adjacent pins to the driving pin.
Figure 16:
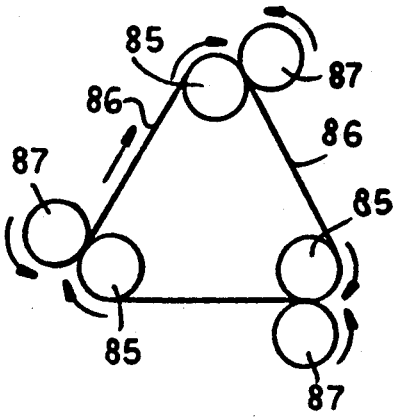

FIGS. 15 and 16 illustrate another arrangement of the belts and pins, having in FIG. 15 a plurality of pin pairs 81, having a belt 84 run between them, and one of the pins 81 is connected to the rotating shafts, rotated by the motor. A third pin 83 is placed in close proximity to the driven pin 81 and the belt 84 run between the pins 81 and 83.

The hair plucking operation is performed at the junction point of pin 81, pin 83 and belt 84.

FIG. 16 illustrates a similar arrangement wherein a triangle of pins 85, driven by rotating shafts, having a belt 86 running between the pins, and next to each pin 85 a second pin 87 is placed and rotated by pin 85 and belt 86. The hair plucking operation occurs in the junction of pins 85 and 87 and belt 86.

While the invention has been described with respect to a preferred and alternate embodiments, it will be appreciated that many other variations, modifications and applications of the invention may be made all within the scope of the claims.

I claim:

1. A depilatory apparatus comprising:

a manually grippable and portable housing including an exterior plate adapted to be moved in juxtaposed relationship to an area of a user's skin from which hair sprouts;

the housing provided with an electric motor and switching means operatively associated therewith for optionally engaging it with and disengaging it from a source of energy;

a plurality of pins arranged to project outwardly from the housing through the plate for engagement with and substantially normal to said skin with the pins connected operatively to the motor for rotation;

an endless belt engaged to run continuously about at least two of the pins, whereby when the pins contact the hair, strands of the hair are caught between at least one of the last-mentioned pins and the belt for clamping the strands therebetween to depilate the strands of hair along said skin;

the motor having a shaft to which the pins are coupled, the number of pins being from 2 to 30 inclusive, the belt being made of an elastomeric material.

2. The depilatory apparatus of claim 1 with means for orienting the pins normal to the plate.

3. A depilatory apparatus comprising:

a manually grippable and portable housing including an exterior plate adapted to be moved in juxtaposed relationship to an area of a user's skin from which hair sprouts, the housing provided with an electric motor and switching means operatively associated therewith for optionally engaging it with and disengaging it from a source of energy, a plurality of slide bearing bores in the plate and each having a T-shaped cross section into which a pin is journaled for rotation and movement perpendicular to the plate, The pins projecting outwardly from the plate for engagement with and substantially normal to said skin, a belt engaged to run continuously about at least two of the pins whereby when the pins are in contact with the hair of the user a strand of the hair is catchable between one of the last mentioned pins and belt for clamping the strand therebetween to pull it along the plate from said skin.

4. A depilatory apparatus comprising:

a manually grippable and portable housing including an exterior plate adapted to be moved in juxtaposed relationship to an area of a user's skin from which hair sprouts;

the housing provided with an electric motor and switching means operatively associated therewith for optionally engaging it with and disengaging it with and disengaging it from a source of energy;

a plurality of pins arranged to project outwardly from the housing through the plate for engagement with and substantially normal to said skin with the pins connected operatively to the motor for rotation;

a belt engaged to run continuously about at least two of the pins, whereby when the pins contact the hair, strands of the hair are caught between at least one of the last mentioned pins and the belt for clamping the strands therebetween to depilate the strands of hair along said skin;

the motor having a shaft to which the pins are coupled, the number of pins being from 2 to 30 inclusive;

the belt being circular in cross section and made of an elastomeric material.

5. A depilatory apparatus comprising;

a manually grippable and portable housing including an exterior plate adapted to be moved in juxtaposed relationship to an area of a user's skin from which hair sprouts;

the housing provided with an electric motor and switching means operatively associated therewith for optionally engaging it with and disengaging it from a source of energy;

a plurality of pins arranged to project outwardly from the housing through the plate for engagement with and substantially normal to said skin with the pins connected operatively to the motor for rotation;

a belt engaged to run continuously about at least two of the pins, whereby when the pins contact the hair, strands of the hair are caught between at least one of the last-mentioned pins and the belt for clamping the strands therebetween to depilate the strands of hair along said skin;

the motor having a shaft to which the pins are coupled, the number of pins being from 2 to 30 inclusive;

the belt being a combination of a flat portion and a portion with a round cross section and made of an elastomeric material.

6. A depilatory apparatus comprising:

a manually grippable and portable housing including an exterior plate adapted to be moved in juxtaposed relationship to an area of a user's skin from which hair sprouts;

the housing provided with an electric motor and switching means operatively associated therewith for optionally engaging it with an disengaging it from a source of energy;

a plurality of pins arranged to project outwardly from the housing through the plate for engagement with and substantially normal to said skin with the pins connected operatively to the motor for rotation;

a belt engaged to run continuously about at least two of the pins, whereby when the pins contact the hair, strands of the hair are caught between at least one of the last-mentioned pins and the belt for clamping the strands therebetween to depilate the strands of hair along said skin;

the motor having a shaft to which the pins are coupled, the number of pins being from 2 to 30 inclusive;

the belt having small teeth-like projections on its surface and made of an elastomeric material.

* * * * *